US007303416B1

(12) United States Patent
Liao

(10) Patent No.: US 7,303,416 B1
(45) Date of Patent: Dec. 4, 2007

(54) COMPOUND CONVERSION PLUG STRUCTURE WITH ADJUSTABLE ANGLE AND ADAPTER

(76) Inventor: Sheng-Hsin Liao, No. 10, Alley 38, Lane 229, San Chun St., Shulin City (TW)

( * ) Notice: Subject to any disclaimer, the term of this patent is extended or adjusted under 35 U.S.C. 154(b) by 0 days.

(21) Appl. No.: 11/703,124

(22) Filed: Feb. 7, 2007

(51) Int. Cl.
*H01R 29/00* (2006.01)

(52) U.S. Cl. ..... 439/173

(58) Field of Classification Search ..... 439/173–175, 439/171, 166, 265, 270, 266, 346
See application file for complete search history.

(56) References Cited

U.S. PATENT DOCUMENTS

| | | | | |
|---|---|---|---|---|
| 5,106,317 | A * | 4/1992 | Taylor | 439/173 |
| 5,159,545 | A * | 10/1992 | Lee | 363/146 |
| 6,171,129 | B1 * | 1/2001 | Phillips | 439/346 |
| 6,780,034 | B2 * | 8/2004 | Shiroshita et al. | 439/174 |
| 6,790,062 | B1 * | 9/2004 | Liao | 439/171 |
| 6,923,666 | B1 * | 8/2005 | Liao | 439/172 |
| 6,935,878 | B2 * | 8/2005 | Hsu et al. | 439/171 |
| 6,939,150 | B1 * | 9/2005 | Lanni | 439/131 |
| 6,991,482 | B1 * | 1/2006 | Liao | 439/166 |
| 7,052,298 | B1 * | 5/2006 | Cheng | 439/171 |
| 7,052,303 | B2 * | 5/2006 | Burton | 439/346 |
| 7,175,463 | B2 * | 2/2007 | Burton | 439/346 |
| 2004/0097114 | A1 * | 5/2004 | Shiroshita et al. | 439/174 |
| 2005/0153587 | A1 * | 7/2005 | Hsu et al. | 439/171 |
| 2006/0030189 | A1 * | 2/2006 | Hsin | 439/166 |

* cited by examiner

*Primary Examiner*—Ross Gushi
(74) *Attorney, Agent, or Firm*—Rosenberg, Klein & Lee

(57) ABSTRACT

A compound conversion plug structure with an adjustable angle includes an adapter and a plug component. The adapter includes an outer shell, a moving block, a plurality of transfer pieces, a plurality of metal inserting pieces, and a plurality of engaging pieces. The moving block defines a guiding groove thereon, and protruding pieces defined on the transfer pieces respectively are set in the guiding groove, the metal inserting pieces are assembled with the transfer pieces, one end of which extends out of the outer shell, and additional ends of the metal inserting pieces engage with the engaging pieces respectively. Because of the structure of the moving block and the transfer piece of the adapter, the metal inserting pieces can be inserted into two types and standards of sockets. Hence, the adapter provides multiple changes to suite actual needs.

19 Claims, 7 Drawing Sheets

COMPOUND CONVERSION PLUG STRUCTURE WITH ADJUSTABLE ANGLE AND ADAPTER

BACKGROUND OF THE INVENTION

1. Field of the Invention

The present invention relates to a compound conversion plug structure, and more specifically to an adapter capable of transfer engaging, and a plug component that can slide and be assembled with the adapter. The adapter suits two standards and types of sockets.

2. Description of the Prior Art

Usually a power supply cord and an electronic device are connected electronically by inserting a plug set on one end of the power supply cord into a corresponding socket. In this manner the power supply cord and the electronic device are connected electronically by the electronical connection between the power supply cord and the electronic device. However, if the standard and type of the plug is different from that of the socket, it is necessary to assemble the plug with an adapter, and then to insert the adapter plug into the socket to connect the plug with the socket electronically.

However, the adapter can only be used with a corresponding socket. If there is another type of socket then the adapter cannot be used. This causes inconvenience for users because they need to buy another type of adapter. For manufacturers costs are increased by necessitating the manufacture of more types of adapters.

Hence, the inventors of the present invention believe that these shortcomings described above are able to be improved upon and suggest the present invention which is of a reasonable design and is an effective improvement based on deep research and thought.

SUMMARY OF THE INVENTION

An object of the present invention is to provide a compound conversion plug structure with an adjustable angle and adapter, which can be inserted into two similar types and standards of sockets to satisfy consumer demands, and reduce manufacturing costs.

To achieve the above-mentioned object, a compound conversion plug structure with an adjustable angle is disclosed, the structure comprises an adapter, which comprises an outer shell and a moving machine. The outer shell defines sliding grooves, the moving machine comprises a moving block, a plurality of transfer pieces, a plurality of metal inserting pieces, and a plurality of engaging pieces. The moving block defines a guiding groove thereon, the transfer pieces are set in the outer shell movably respectively, and protruding pieces defined on the transfer pieces respectively are set in the guiding groove. The metal inserting pieces are assembled with the transfer pieces and one end of each extends out of the outer shell. The engaging pieces are set in the outer shell respectively, and additional ends of the metal inserting pieces engage with the engaging pieces respectively. A plug component is assembled with the adapter movably and can be disassembled, a plurality of metal plugs is set on the end face of the plug component, and the metal plugs engage with the engaging pieces respectively.

Two side arms are set on two side walls of the outer shell, and protruding poles are set on the arms. Two side walls of the plug component define sliding grooves thereon respectively, and the protruding poles can be set in sliding grooves respectively.

The advantages of the present invention are:

1. When the plug component isn't in use, via the protruding poles and the sliding grooves, the plug component can slide between the two side arms and rotate in different directions; hence, it is unnecessary to disassemble the plug component when only the plug component needs to be used, so it is more convenient for users.

2. Because of the structure of the moving block and the transfer piece of the adapter, the metal inserting pieces can be inserted into two types and standards of sockets to satisfy consumer demands and reduce manufacturing costs.

To further understand the features and technical contents of the present invention, please refer to the following detailed description and drawings related to the present invention. However, the drawings are only to be used as references and explanations, and not to limit the present invention.

DETAILED DESCRIPTION OF THE PREFERRED EMBODIMENTS

Figure 1:
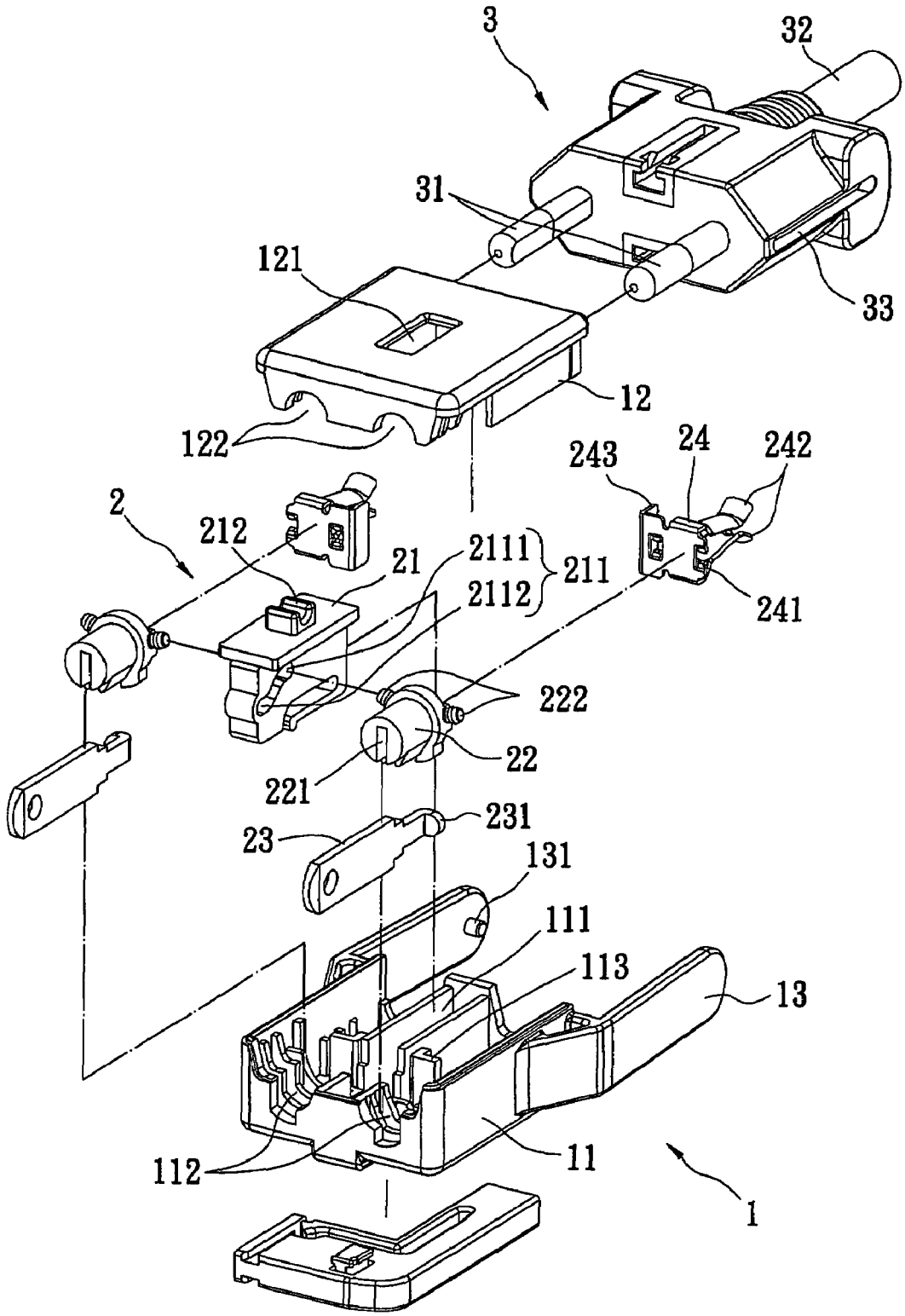
FIG. 1 is an explored isometric view of the present invention.
Figure 2:
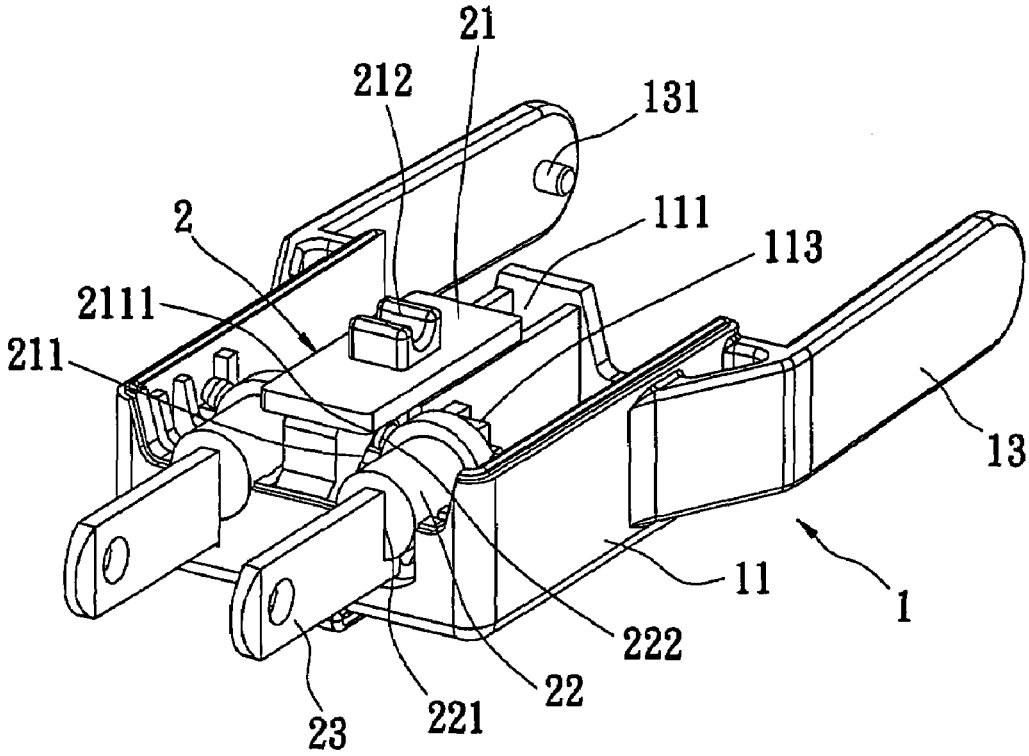
FIG. 2 is an isometric view of an adapter of the present invention.

Referring to FIGS. 1-2, a compound conversion plug structure with an adjustable angle of the present invention is shown. The compound conversion plug structure includes an outer shell 1, a moving machine 2, and a plug component 3. The outer shell 1 and the moving machine 2 together form an adapter.

The outer shell 1 includes an integrating base 11, an integrating cover 12, and two side arms 13. A groove 111 is defined at the center of the integrating base 11. Two first containing portions 112 are defined concavely and two L-shaped locating blocks 113 protrude near two outsides of the groove 111 respectively. A notch 121 is defined on the surface of the integrating cover 12. Two second containing portions 122 are defined concavely below an end of the integrating cover 12.

The two side arms 13 integrate with the two side edges of the integrating base 11 by an in-molding method respectively, or alternatively, by a pivoting method with the two side edges thereof respectively. Thus, the two side arms 13 can rotate (not shown). Two protruding poles 131 are set on inside walls of the two side arms 13 respectively.

The moving machine 2 includes a moving block 21, two transfer pieces 22, two metal inserting pieces 23, and two engaging pieces 24. A guiding groove 211 is defined on the sidewall of the moving block 21. The guiding groove 211 includes a first groove 2111 and a second groove 2112. The first groove 2111 is higher than the second groove 2112. A protruding portion 212 protrudes upwards from a topside of the moving block 21.

The transfer piece 22 has a symmetrical structure and is cylinder-shaped. A containing groove 221 is defined concavely thereon along the axis of the transfer piece 22. Two protruding pieces 222 are defined symmetrically on the sidewall of the transfer piece 22. The section shape of the protruding piece 222 can be circular, triangular, or polygonal.

The metal inserting piece 23 has a symmetrical structure and is made of electric metal. A contact portion 231 is bended outwards from the back end of the metal inserting piece 23.

The engaging piece 24 has a symmetrical structure and is made of metal. A blocking groove 241 is defined on the surface of the engaging piece 24, and a pair of elastic clipping arms 242 extends backwards from two sidewalls of the engaging piece 24. A locating portion 243 extends backwards from a sidewall of the engaging piece 24.

The plug component 3 is a two-pronged or a three-pronged power supply plug, and the two-pronged power supply plug is selected as an embodiment of the present invention to mate with the adapter. Two metal plugs 31 are set on the front end of the plug component 3. A power supply cord 32 is set on the back end of the plug component 3 to connect electrically with the metal plugs 31. Two sliding grooves 33 are defined concavely on two sidewalls of the plug component 3 respectively. Furthermore, the metal plugs 31 and the metal inserting pieces 23 of the adapter are power supply pins and of different standards and types. The metal inserting pieces 23 are flat power supply pins, and the metal plugs 31 are columniform power supply pins.

The moving block 21 is set in the groove 111 and can move frontward and backward therein. The metal inserting pieces 23 are inserted into the two containing grooves 221 of the transfer pieces 22 respectively and extend out of the transfer pieces 22. The transfer pieces 22 are movably contained in the first containing portions 112 of the integrating base 11 respectively. One of the protruding pieces 222 is contained in the guiding groove 211 simultaneously, and the engaging pieces 24 are set on two sides of the groove 111 respectively. The locating portion 243 is inserted between the L-shaped locating block 113 and the groove 111 to fix the engaging pieces 24 within the integrating base 11. The clipping arms 242 face backward. Moreover, the back end of the metal inserting piece 23 is blocked by the blocking groove 241 of the engaging pieces 24 to make the clipping arms 242 clip the contact portion 231 therein.

The integrating cover 12 and the integrating base 11 are blocked by each other to engage together, and the second containing portions 122 engage with the corresponding first containing portions 112 respectively to take in the transfer pieces 22 simultaneously. The front ends of the metal inserting pieces 23 extend out of the integrating base 11 and the integrating cover 12. Simultaneously, the protruding portion 212 of the moving block 21 is set in the notch 121 of the integrating cover 12. The protruding portion 212 is smaller than the scope of the notch 121. Thereby, the adapter of the invention is configured.

The plug component 3 and the outer shell 1 can be disassembled. The protruding poles 131 of the two side arms 13 are set in the corresponding sliding grooves 33 respectively. Via the assembling method of the protruding poles 131 connecting with the sliding grooves 33, the plug component 3 can be set between the two side arms 13 movably. The metal plugs 31 extend into the outer shell 1 movably to be clipped in the clipping arms 242 of the engaging pieces 24 and further contact the contact portions 231 of the metal inserting pieces 23. In this manner the electrical connection is completed.

After the plug component 3 has been assembled with the outer shell 1 and when the plug component 3 isn't in use, users can pull the plug component 3 to make the metal plugs 31 move away from the engaging pieces 24 via the protruding poles 131 and the sliding grooves 33. The plug component 3 can slide between the two side arms 13 and rotate in different directions, hence, it is unnecessary to disassemble the plug component 3 when it is used solely, so convenience is increased for users.

What is also worthy of being mentioned is that the two side arms 13 and the protruding poles 131 of the plug component 3 and the sliding grooves 33 can be exchanged reciprocally to be set between the two side arms 13 and on the two side ends of the plug component 3, that is, additional sliding grooves (not shown) are defined on the two side arms 13, and additional protruding poles (not shown) are defined on two side ends of the plug component 3, thereby achieving the same improvements in convenience for consumers.

Figure 3:
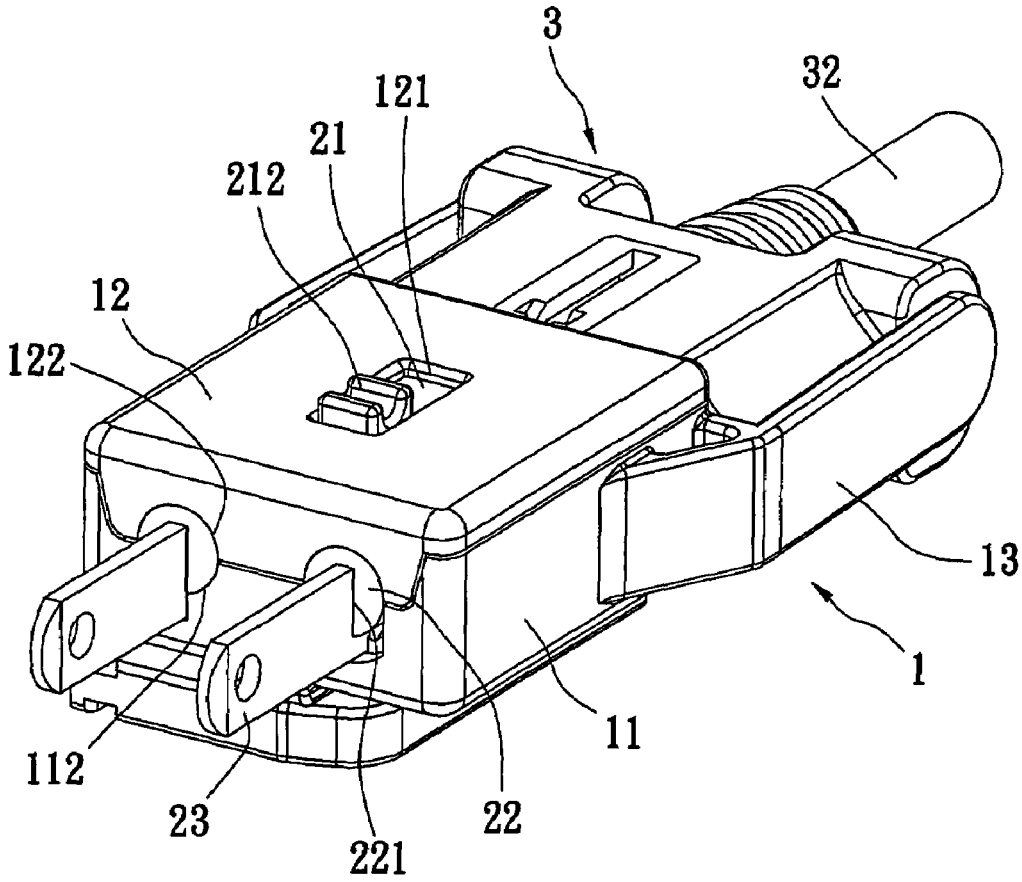
FIG. 3 is an assembled isometric view of the present invention.
Figure 4:
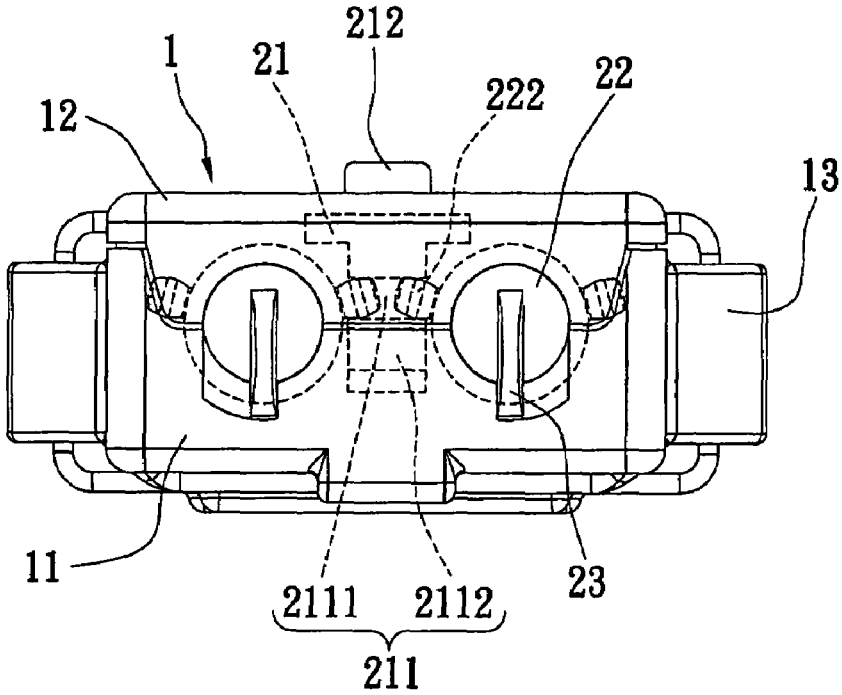
FIG. 4 is an isometric view of the adapter in use of the present invention.
Figure 5:
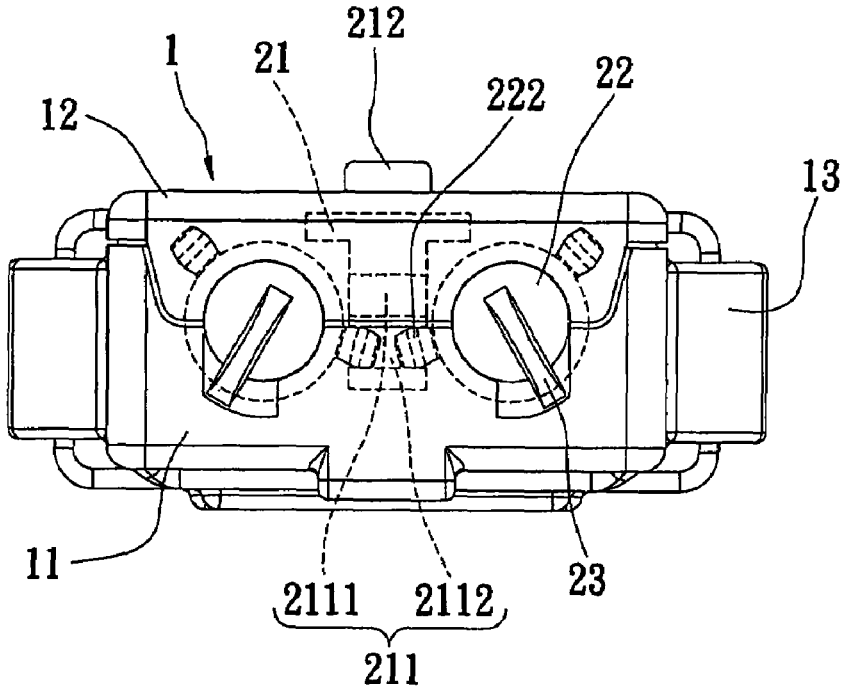
FIG. 5 is another isometric view of the adapter in use of the present invention.

Referring to FIGS. 3-5, when the adapter of the present invention is to be inserted into a two-pronged flat socket (not shown), and when the protruding pieces 222 of the moving machine 2 are set in the first groove 2111 of the guiding groove 211, the two metal inserting pieces 23 are parallel each other and can be inserted into the socket directly.

When inserting the adapter into a two-pronged flat inverted V-shaped socket (not shown), users can manually push the protruding portion 212 to move the moving block 21, thereby the protruding pieces 222 move towards the second groove 2112 little by little and up and down. Thus, the two transfer pieces 22 rotate in a clockwise direction and in an anti-clockwise direction respectively and simultaneously. The two metal inserting pieces 23 are driven to rotate until the inverted V-shaped state forms. Once the inverted V-shaped state has formed, the adapter can be inserted into the socket directly. By the above-mentioned specification, when the moving block 21 moves forward or backward, the protruding poles 131 of the two transfer pieces 22 slide between the first groove 2111 or the second groove 2112 alternatively, and the two transfer pieces 22 rotate in the clockwise direction and in the anti-clockwise direction respectively, thus, the metal plugs 31 can be inverted V-shaped or parallel to each other.

Figure 6:
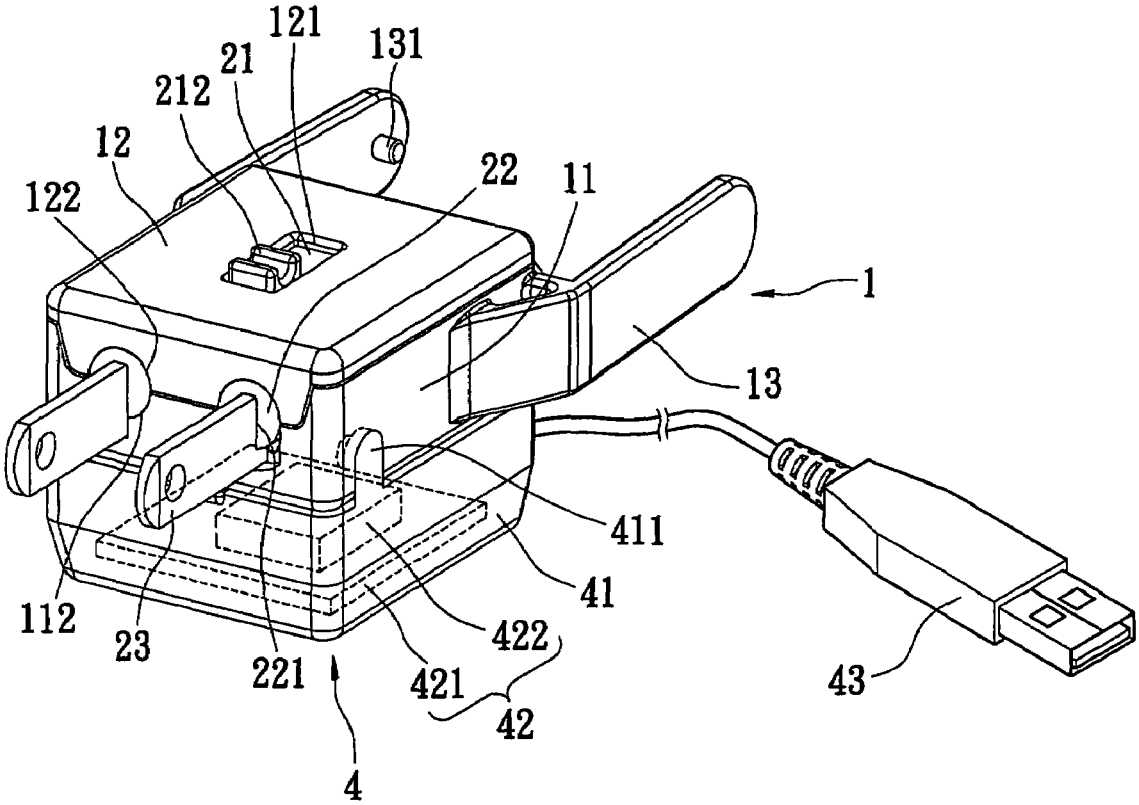
FIG. 6 is an assembled isometric view of the adapter integrating with a charging device of the present invention.

Referring to FIG. 6, the adapter of the present invention further includes a charging device 4 which includes an outer covering 41, a circuit module 42 and at least one port 43. The outer covering 41 is a hollow case, and the circuit module 42 is set inside the outer shell 1 and includes a circuit board 421 and electronic components 422. The electronic components 422 are mounted on the circuit board 421 and include a charge IC, resistances or capacitances, and so on. The circuit module 42 connects electronically to the metal inserting pieces 23. The port 43 can be a male plug or a female plug, one end of which is exposed out of the outer covering 41. The other end connects electronically to the circuit module 42. The port 43 is a male connector such as a USB, or a DC male/female plug, and so on.

The outer covering 41 integrates with one side of the outer shell 1 by a buckle structure, or by two pin-jointed portions 411 extending from two sides of the outer covering 41 respectively. The two pin-jointed portions 411 are pivoted onto the two sidewalls of the integrating base 11 respectively to move the outer covering 41 up and down.

When the port 43 is inserted into a corresponding electronic device (not shown), such as a mobile phone, a PDA, and so on, only the adapter of the present invention is inserted into the socket, and the voltage is adjusted by the circuit module 42 of the charging device 4. Thereby, the electronic device is charged, which gives the adapter of the present invention multiple functions.

Figure 7:
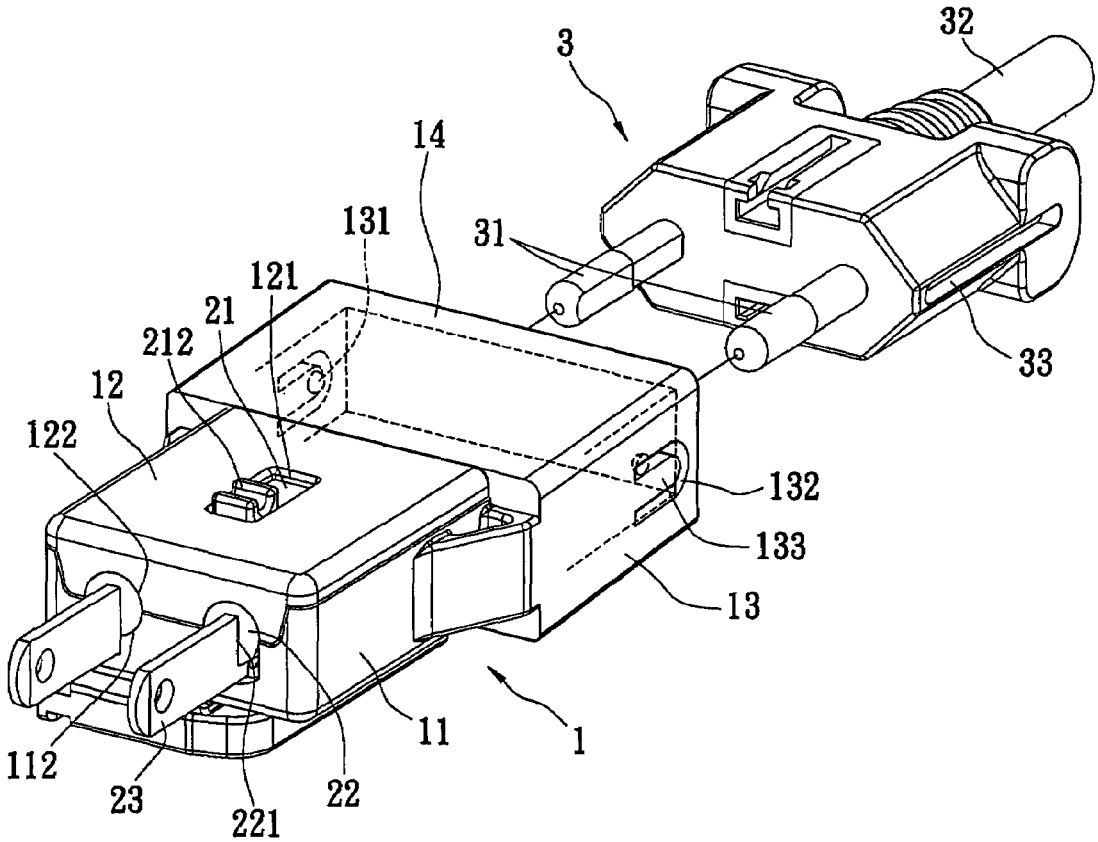
FIG. 7 is an isometric view of the adapter of another embodiment of the present invention.

In addition, referring to FIG. 7, some changes can be made on the adapter of the present invention. This embodiment differs to the previously mentioned structure in that two shielding walls 14 are set on the two up-down opposite ends of the two side arms 13 respectively. The shielding walls 14 are also in-molded with the side arms 13, hence, the shapes of the side arms 13 are changed into an a hollow case. Moreover, two U-shaped notches 132 are defined on the side arms 13 respectively, the protruding poles 131 connect to elastic ribs 133 formed by the U-shaped notches 132 on the side arms 13 respectively, and the protruding poles 131 have appropriate elasticity after the plug component 3 has been assembled with the outer shell 1. By assembling the protruding poles 131, the elastic ribs 133 and the notches 132, the protruding poles 131 are blocked elastically in the sliding grooves 33 of the plug component 3. Hence, the plug component 3 received in the side arms 13 and the shielding walls 14 can move forward and backward.

Figure 8:
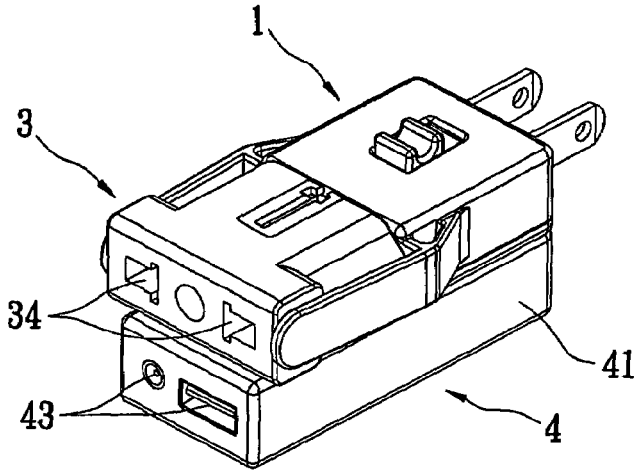
FIG. 8 is a first assembled isometric view of an adapter integrating with a charging device of the present invention.
Figure 9:
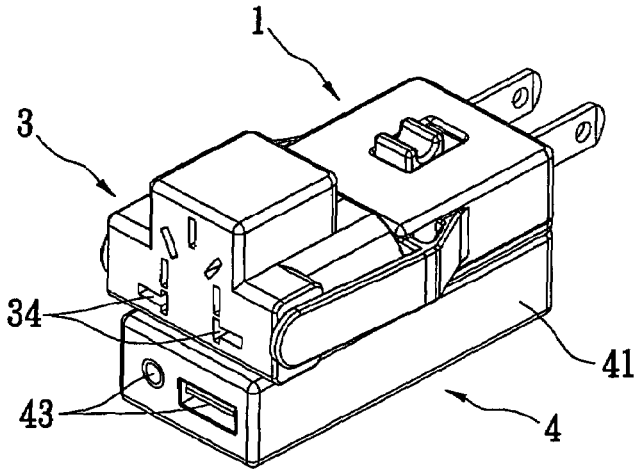
FIG. 9 is a second assembled isometric view of an adapter integrating with a charging device of the present invention.

Referring to FIGS. 8-9, and referring to FIG. 1 corporately, for the embodiment of the FIG. 1, an opposite end of the plug component 3 is the power supply cord 32. However, for the present embodiment, the power supply cord 32 is replaced by a socket 34. The standard of the socket 34 can be two-pronged or three-pronged and is suitable for standards in every country. The socket 34 and the metal plugs 31 are different in standard, for example, the metal plugs 31 are two-pronged, but the socket 34 is three-pronged. Thus, the plug component 3 has another type of adapter.

Moreover, as shown in FIGS. 8-9, and differing to the previously mentioned embodiments, the port 43 of the charging device 4 further includes a female USB connector and a female DC socket. In FIG. 9, the socket 34 of the plug component 3 further includes a plurality of sockets which meet different standards, such as a standard US socket or a standard UK socket, and so on. Thus, the plug component 3 is suitable for multiple types of power supply plugs.

Figure 10:
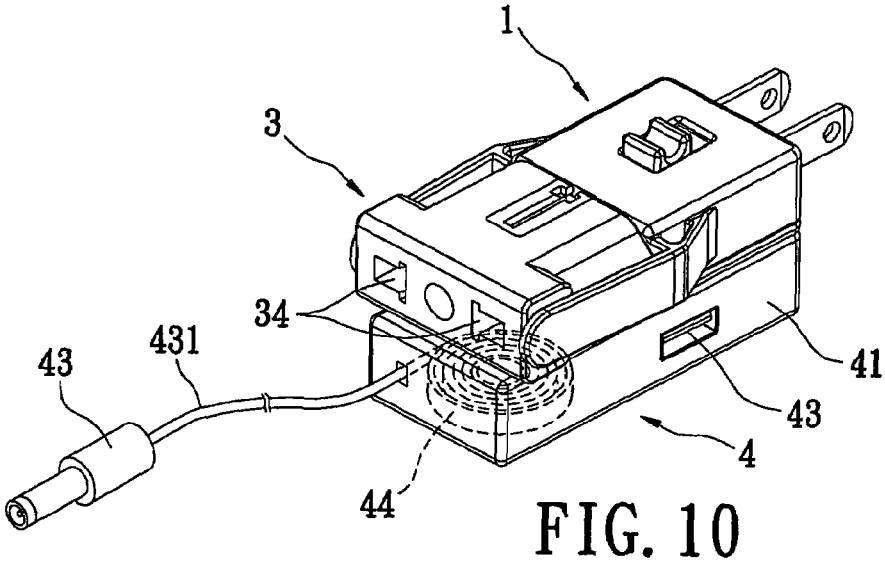
FIG. 10 is a third assembled isometric view of an adapter integrating with a charging device of the present invention.

Referring to FIG. 10, the port 43 of the charging device 4 can be any type of male connector or a male/female plug. A cable 431 is set thereof, a cable reel 44 is set inside the outer covering 41, the cable 431 of the port 43 is reeled inside the outer covering 41, and the port 43 can be pulled out to a suitable distance for use.

In summary, when assembled in the adapter, the plug component 3 connects electrically to the metal inserting pieces 23. By the cooperation of the protruding poles 131 and sliding grooves 33, when not being used, the plug component 3 slides between the two side arms 13 and turns in a different direction. Hence, no other components are required apart from the plug component 3, and the adapter doesn't need to be disassembled, and is therefore more convenient.

For the adapter of the present invention, by the structure of the moving block 21 and the transfer pieces 22, the two metal inserting pieces 23 can be inserted into two standards of the sockets alternatively. Hence, the adapter provides multiple changes to suite actual needs, and manufacturing costs are reduced.

What is disclosed above are only the preferred embodiments of the present invention, and therefore it is intended that the present invention not be limited to the particular embodiment disclosed. It should be understood by those skilled in the art that various equivalent changes may be made depending on the specification and the drawings of present invention without departing from the scope of the present invention.

What is claimed is:

1. A compound conversion plug structure with an adjustable angle, comprising:

an adapter, comprising an outer shell and a moving machine, the moving machine comprising a moving block, a plurality of transfer pieces, a plurality of metal inserting pieces and a plurality of engaging pieces, the moving block defines a guiding groove thereon, the transfer pieces are movably set in the outer shell, and protruding pieces defined on the transfer pieces respectively are set in the guiding groove, the metal inserting pieces are assembled with the transfer pieces one end of which extends out of the outer shell, the engaging pieces are set in the outer shell respectively, and additional ends of the metal inserting pieces engage with the engaging pieces respectively; and a plug component assembled with the adapter movably which can be disassembled, a plurality of metal plugs are set on the end of the plug component, and the metal plugs engage with the engaging pieces respectively.

2. The compound conversion plug structure with an adjustable angle as claimed in claim 1, wherein a notch is defined on the outer shell, and a protruding portion protruding from the moving block is set in the notch.

3. The compound conversion plug structure with an adjustable angle as claimed in claim 1, wherein a first groove and a second groove are defined in the guiding groove, the first groove is higher than the second groove, and the protruding pieces are set in the first groove and the second groove alternatively.

4. The compound conversion plug structure with an adjustable angle as claimed in claim 1, wherein clipping arms extend from the engaging pieces respectively to clip the metal inserting pieces.

5. The compound conversion plug structure with an adjustable angle as claimed in claim 1, wherein two side arms are set on the two side edges of the outer shell respectively, and the plug component moves between the side arms.

6. The compound conversion plug structure with an adjustable angle as claimed in claim 5, wherein the outer shell comprises an integrating base and an integrating cover, the integrating base defines a groove thereon, the moving block is set in the groove movably, and the side arms integrate with the two sides of the integrating base.

7. The compound conversion plug structure with an adjustable angle as claimed in claim 5, wherein two shielding walls are set on the two opposite ends of the two side arms respectively to receive the plug component.

8. The compound conversion plug structure with an adjustable angle as claimed in claim 5, wherein protruding poles are set on the two side arms respectively, sliding grooves are defined on the side walls of the plug component respectively, and the protruding poles are set in the sliding grooves respectively.

9. The compound conversion plug structure with an adjustable angle as claimed in claim 5, wherein sliding grooves are defined on the two side arms, protruding poles are set on the side walls of the plug component, and the protruding poles are set in the sliding grooves respectively.

10. A compound conversion plug structure with an adjustable angle, comprising:

an outer shell; and a moving machine, comprising a moving block, a plurality of transfer pieces, a plurality of metal inserting pieces and a plurality of engaging pieces, the moving block is set in the outer shell movably and defines a guiding groove thereon, the transfer pieces are movably set in the outer shell, and protruding pieces defined on the transfer pieces respectively are set in the guiding groove, the metal inserting pieces are assembled with the transfer pieces one end of which extends out of the outer shell, the engaging pieces are set in the outer shell respectively, and additional ends of the metal inserting pieces engage with the engaging pieces respectively.

11. The compound conversion plug structure with an adjustable angle as claimed in claim 10, wherein a notch is defined on the outer shell, and a protruding portion protruding from the moving block is set in the notch.

12. The compound conversion plug structure with an adjustable angle as claimed in claim 10, wherein a first groove and a second groove are defined in the guiding groove, the first groove is higher than the second groove, and the protruding pieces are set in the first groove and the second groove alternatively.

13. The compound conversion plug structure with an adjustable angle as claimed in claim 10, wherein a pair of clipping arms extends from the engaging pieces respectively.

14. The compound conversion plug structure with an adjustable angle as claimed in claim 10, wherein two side arms are set on the two side edges of the outer shell respectively.

15. The compound conversion plug structure with an adjustable angle as claimed in claim 14, wherein the outer shell comprises an integrating base and an integrating cover integrated with each other, the integrating base defines a groove thereon, the moving block is set in the groove movably, and the side arms integrate with the two sides of the integrating base.

16. The compound conversion plug structure with an adjustable angle as claimed in claim 14, wherein two shielding walls are set on the two opposite ends of the two side arms to connect with the two side arms respectively.

17. The compound conversion plug structure with an adjustable angle as claimed in claim 14, wherein protruding poles or sliding grooves are set on the two side arms respectively.

18. The compound conversion plug structure with an adjustable angle as claimed in claim 10, wherein a charging device is integrated with the outer shell and connects electronically to the metal inserting pieces.

19. The compound conversion plug structure with an adjustable angle as claimed in claim 18, wherein the charging device comprises an outer covering, a circuit module and at least one port, the outer covering shell integrates with an end of the outer shell, the circuit module is set inside the outer covering, and the port connects electronically to the circuit module.

* * * * *